US005850633A

United States Patent [19]

Lovin

[11] Patent Number: 5,850,633

[45] Date of Patent: Dec. 22, 1998

[54] BASEBALL GLOVE WITH ELONGATED STRAP

[76] Inventor: Kenneth Paul Lovin, 1514 S. Longview St., Beavercreek, Ohio 45432

[21] Appl. No.: 751,761

[22] Filed: Nov. 8, 1996

[51] Int. Cl.[6] ..... A41D 13/10; A41D 19/00

[52] U.S. Cl. ..... 2/19; 2/162

[58] Field of Search ..... 2/16, 19, 160, 2/161.1, 161.4, 161.5, 161.6, 162, 170

[56] References Cited

U.S. PATENT DOCUMENTS

| | | | |
|---|---|---|---|
| 4,065,813 | 1/1978 | Hudson | 2/162 |
| 4,541,127 | 9/1985 | Gould . | |
| 4,651,345 | 3/1987 | Latina . | |
| 4,853,975 | 8/1989 | Clevenhagen . | |
| 4,891,845 | 1/1990 | Hayes . | |
| 4,896,376 | 1/1990 | Miner . | |
| 4,937,882 | 7/1990 | Hayes . | |
| 5,031,238 | 7/1991 | Hayes . | |
| 5,214,798 | 6/1993 | McLaughlin . | |
| 5,457,819 | 10/1995 | Aoki . | |

FOREIGN PATENT DOCUMENTS

| | | |
|---|---|---|
| 406038 | 2/1934 | United Kingdom . |
| 468296 | 7/1937 | United Kingdom . |

*Primary Examiner*—C. D. Crowder
*Assistant Examiner*—Larry D. Worrell
*Attorney, Agent, or Firm*—Richard C. Litman

[57] ABSTRACT

A baseball glove having a bipartite wrist section, a wrist strap attached to one portion of the wrist section, and a ring attached to the other portion of the wrist section. The strap, which includes an extension is looped through the ring and around the wrist to secure the two portions together, providing stability and a secure fit to the glove.

2 Claims, 2 Drawing Sheets

BASEBALL GLOVE WITH ELONGATED STRAP

BACKGROUND OF THE INVENTION

1. Field of the Invention

The present invention relates to an attachment for a baseball glove.

2. Description of the Prior Art

The present invention relates to a baseball glove having a wrist strap to secure a bipartite wrist section of the glove together. The strap has an extension which allows the strap to wrap completely around the lower arm of a wearer.

U.S. Pat. Nos. 4,541,127, issued on Sep. 17, 1985 to Russell J. Gould, 4,891,845, issued on Jan. 9, 1990 to Rufus Hayes, 4,937,882 issued on Jul. 3, 1990 to Rufus Hayes, and 5,031,238, issued on Jul. 16, 1991 to Rufus Hayes, teach protection and support devices which attach to a baseball glove and encircles the wrist. These protection devices are unrelated to the securement device of the instant invention, i.e., for securing a bipartite wrist section of a baseball glove together.

U.S. Pat. Nos. 4,651,345, issued on Mar. 24, 1987 to Roland N. Latina, 4,853,975, issued on Aug. 8, 1989 to Robert L. Clevenhagan, 4,896,376, issued on Jan. 30, 1990 to Monte A. Miner, 5,214,798, issued on Jun. 1, 1993 to Daryl L. McLaughlin, and 5,457,819, issued on Oct. 17, 1995 to Akio Aoki, teach straps for securing baseball gloves. However, none of these straps wraps around the wrist or the lower arm.

None of the above inventions and patents, taken either singly or in combination, is seen to describe the instant invention as claimed.

SUMMARY OF THE INVENTION

The present invention relates to a baseball glove having a bipartite wrist section, a wrist strap attached to one portion of the wrist section, and a ring attached to the other portion of the wrist section. The strap, which includes an extension is looped through the ring and around the wrist to secure the two portions together.

Accordingly, it is a principal object of the invention to provide a baseball glove which is firmly secured to the hand by a wrist strap which completely encircles the wrist.

It is another object of the invention to provide a baseball glove which fits better and is more stable than other baseball gloves.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
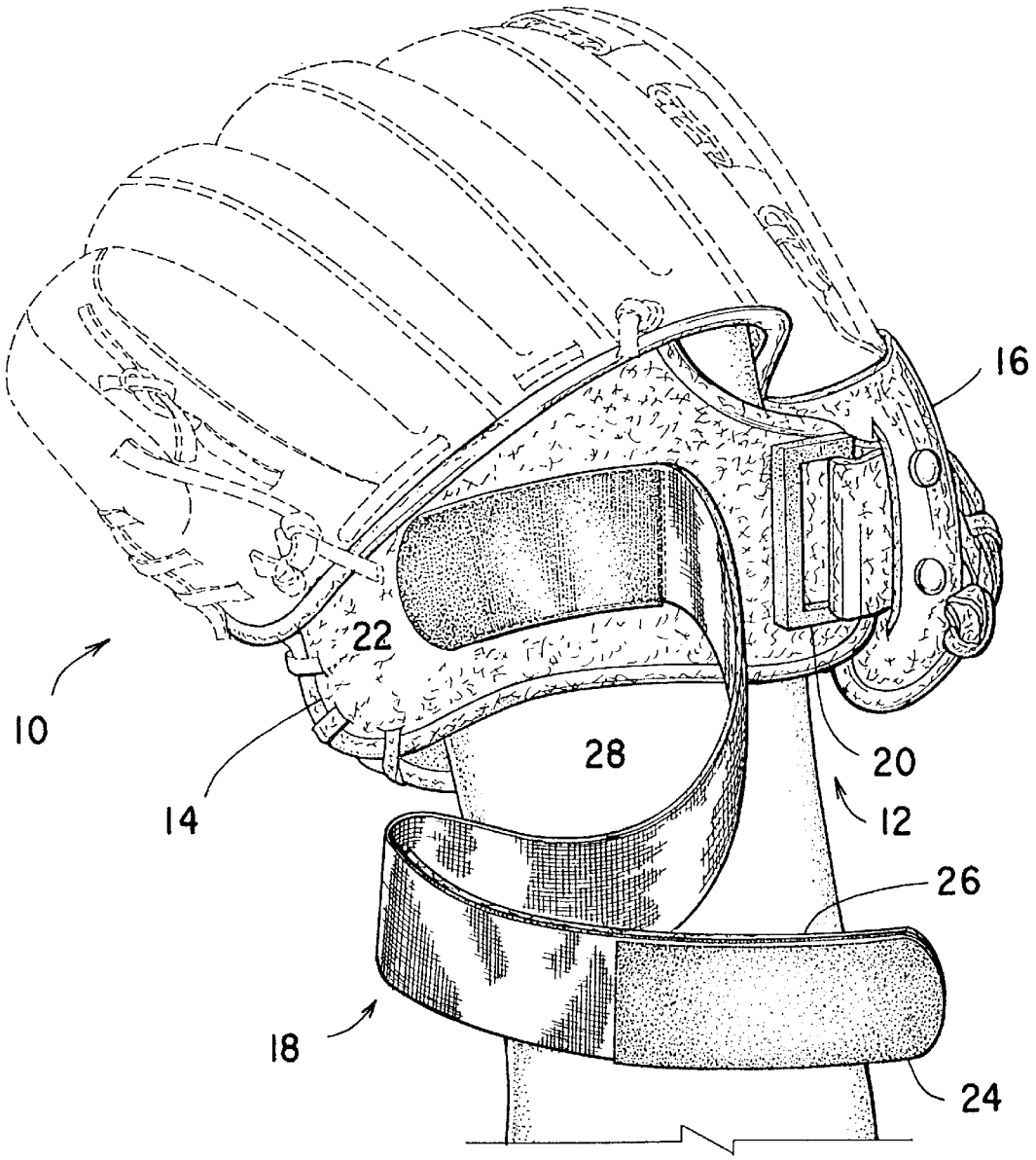
FIG. 1 is an environmental perspective view of the glove on a hand with the strap unfastened.

The present invention is seen in FIG. 1. A baseball glove 10 has a bipartite wrist section 12 having a first portion 14 and a second portion 16. A wrist strap 18 is attached to the first portion 14 of the wrist section 12, and a ring 20 is attached to the second portion 16 of the wrist section 12. The wrist strap 18 includes a first patch of hook or loop fastening materials 22 stitched onto the glove 10 at the proximate section 17 of the wrist strap 18 and the first portion 14 of the wrist section 12. The wrist strap 18 further includes an extension 28 having a first surface 27, a second surface 29, and a distal section 19. A second patch of mating fastening material 24 is stitched to the distal section 19 of the extension 28 on the same side of the strap 18, i.e. facing the wearer of the glove 10. A leather portion 26 is stitched to the second surface 29 at the distal section 19 of the extension 28. The extension portion 28 is made of flexible material, preferably nylon.

Figure 2:
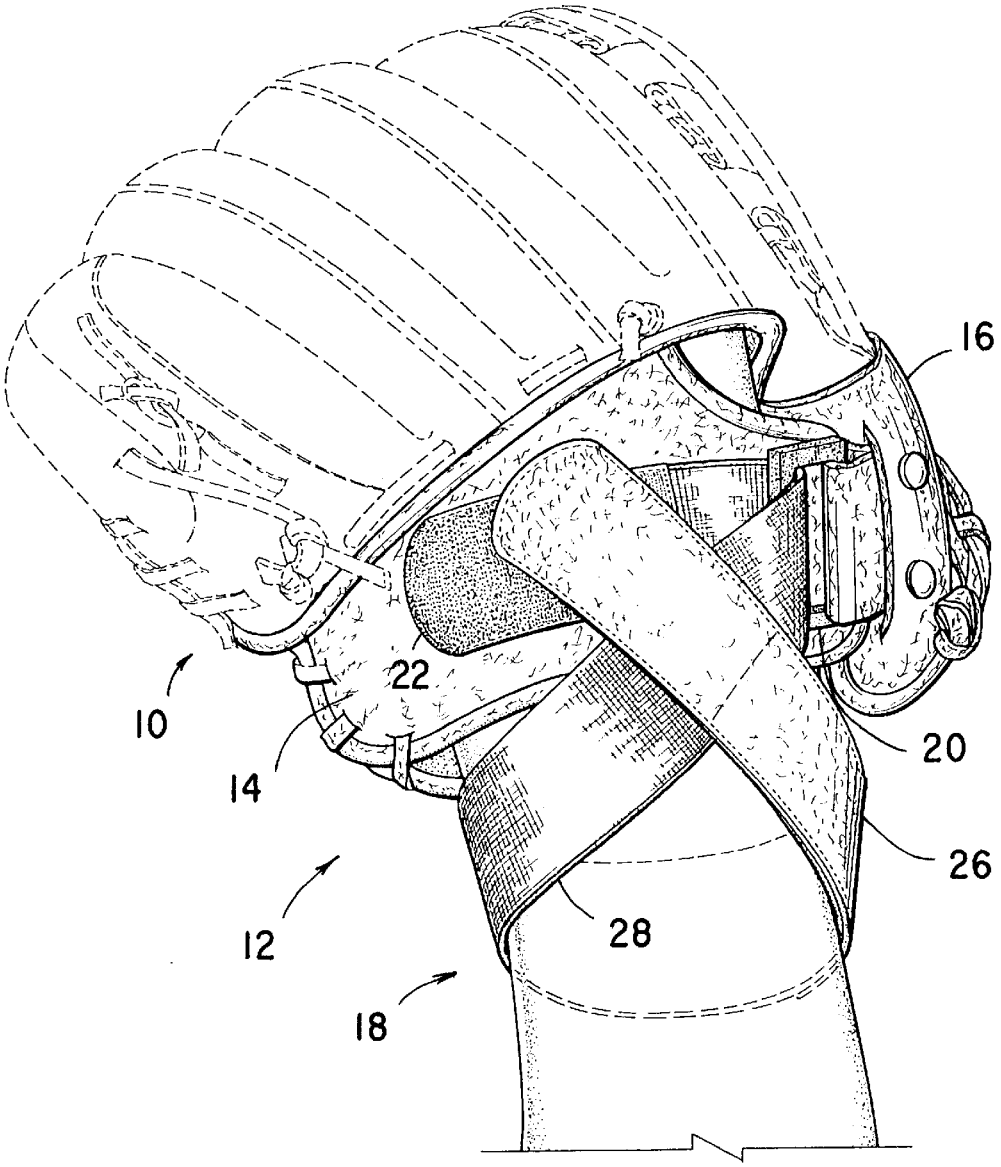
FIG. 2 is an environmental perspective view of the glove on a hand with the strap secured around the wrist.

The strap 18 is looped through ring 20 and around the wearer's wrist (as shown in FIG. 2). The two patches of fastening material 22 and 24 are fastened together securing the two portions 14 and 16 together and the glove 10 on the wearer's hand. To remove the glove 10, the user unfastens the patches of fastening material 22 and 24, unwinds the strap 18 from the wrist or lower arm, and slides the strap 18 within the ring 20 to loosen it. The strap 18 need not be removed from the ring 20 because it can be sufficiently loosened, and it simplifies the procedure of putting on and taking off the glove 10.

The strap 18 has a degree of adjustability which can be achieved by the relative positions of the patches of fastening material 22 and 24. However, an additional degree of adjustability can be provided by the inclusion of a sliding buckle on the strap.

It is to be understood that the present invention is not limited to the sole embodiment described above, but encompasses any and all embodiments within the scope of the following claims.

I claim:

1. A baseball glove comprising:

a bipartite wrist section having a first portion and a second portion, an elongated wrist strap having a proximate section attached to said first portion of the glove and an extension having a distal section, said extension being made of a fabric material and including a first surface and an opposing second surface, a ring attached to said second portion, a first patch of fastening material attached at said proximate section, a second patch of mating fastening material attached to said first surface at said distal section, and a leather portion attached to said second surface at said distal section, said extension being of predetermined and sufficient length to be looped through said ring, wrapped around a wrist of a user and fastened to said proximate section to secure the glove to the user's hand.

2. The glove of claim 1 wherein said extension being made of nylon.

* * * * *